US007573206B2

(12) United States Patent
Nicholson et al.

(10) Patent No.: US 7,573,206 B2
(45) Date of Patent: Aug. 11, 2009

(54) PERCEPTIBLE FLICKERING REDUCTION

(75) Inventors: Peter C. Nicholson, Vancouver, WA (US); David E. Smith, Vancouver, WA (US); Kenneth B. Wade, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 494 days.

(21) Appl. No.: 11/334,634

(22) Filed: Jan. 17, 2006

(65) Prior Publication Data

US 2007/0164714 A1 Jul. 19, 2007

(51) Int. Cl.
*H05B 37/00* (2006.01)

(52) U.S. Cl. ..... 315/291; 315/295; 315/299; 307/112

(58) Field of Classification Search ..... 315/291, 315/294, 295, 299, 312, 313; 307/43, 75, 307/112, 114
See application file for complete search history.

(56) References Cited

U.S. PATENT DOCUMENTS 4,377,739 A 3/1983 Eckert, Jr. et al.
4,900,900 A 2/1990 Shirae et al.
5,747,774 A 5/1998 Suzuki et al.
6,064,124 A * 5/2000 Inukai ..... 307/43
6,133,697 A 10/2000 Nagai et al.
6,291,945 B1 9/2001 Toyama et al.
6,359,393 B1 3/2002 Brown
6,538,395 B2 3/2003 Szabados
6,590,348 B2 7/2003 Takahashi et al.
6,700,331 B2 3/2004 Benensohn
2004/0183487 A1 9/2004 Ueda et al.

FOREIGN PATENT DOCUMENTS

JP 2003-338396 * 11/2003

* cited by examiner

*Primary Examiner*—David Hung Vu

(57) ABSTRACT

A system includes a load, one or more switches, and a controller. The switches are to switch power received from a power source to power the load. The controller is to control switching of the switches to deliver the power to the load to reduce perceptible flickering of one or more lights coupled to the power source.

15 Claims, 5 Drawing Sheets

202
204
AC MAINS

206
FIRST SWITCH

50% POWER
SECOND SWITCH
208
210
FIRST SWITCH

25% POWER
SECOND SWITCH
212
214
FIRST SWITCH

75% POWER
216
SECOND SWITCH

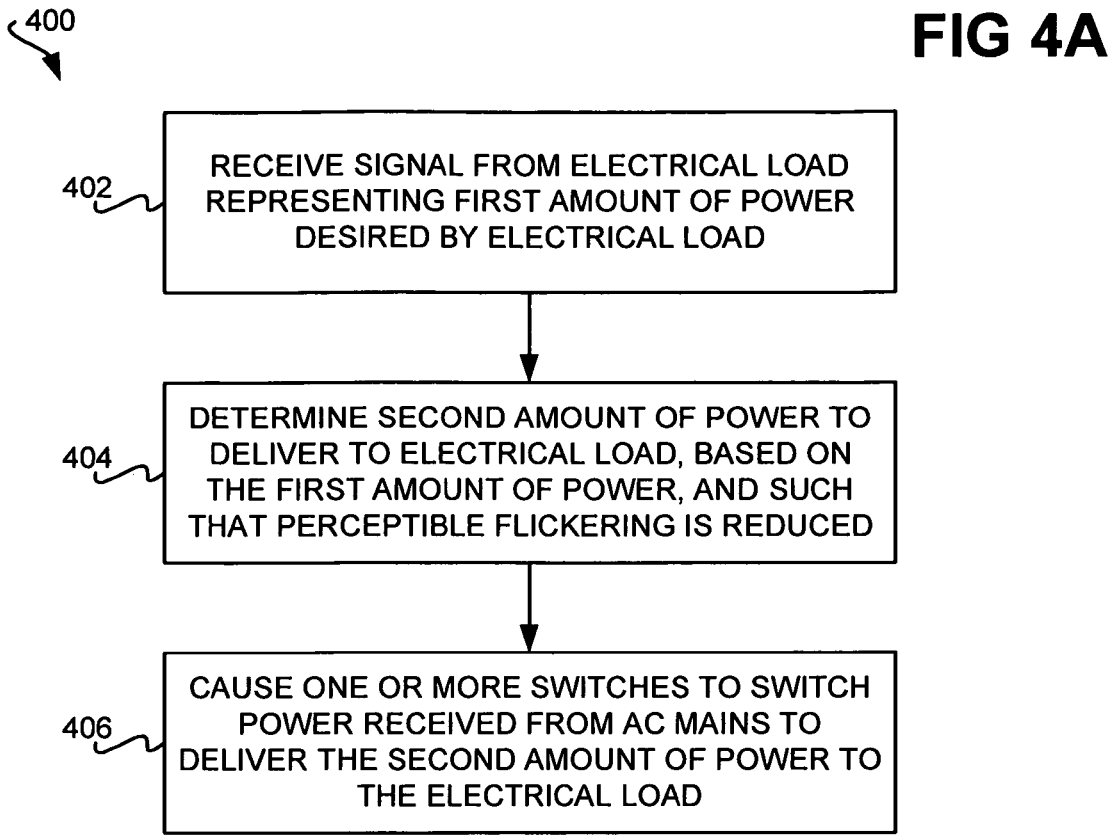
400
FIG 4A
402
RECEIVE SIGNAL FROM ELECTRICAL LOAD REPRESENTING FIRST AMOUNT OF POWER DESIRED BY ELECTRICAL LOAD
404
DETERMINE SECOND AMOUNT OF POWER TO DELIVER TO ELECTRICAL LOAD, BASED ON THE FIRST AMOUNT OF POWER, AND SUCH THAT PERCEPTIBLE FLICKERING IS REDUCED
406
CAUSE ONE OR MORE SWITCHES TO SWITCH POWER RECEIVED FROM AC MAINS TO DELIVER THE SECOND AMOUNT OF POWER TO THE ELECTRICAL LOAD

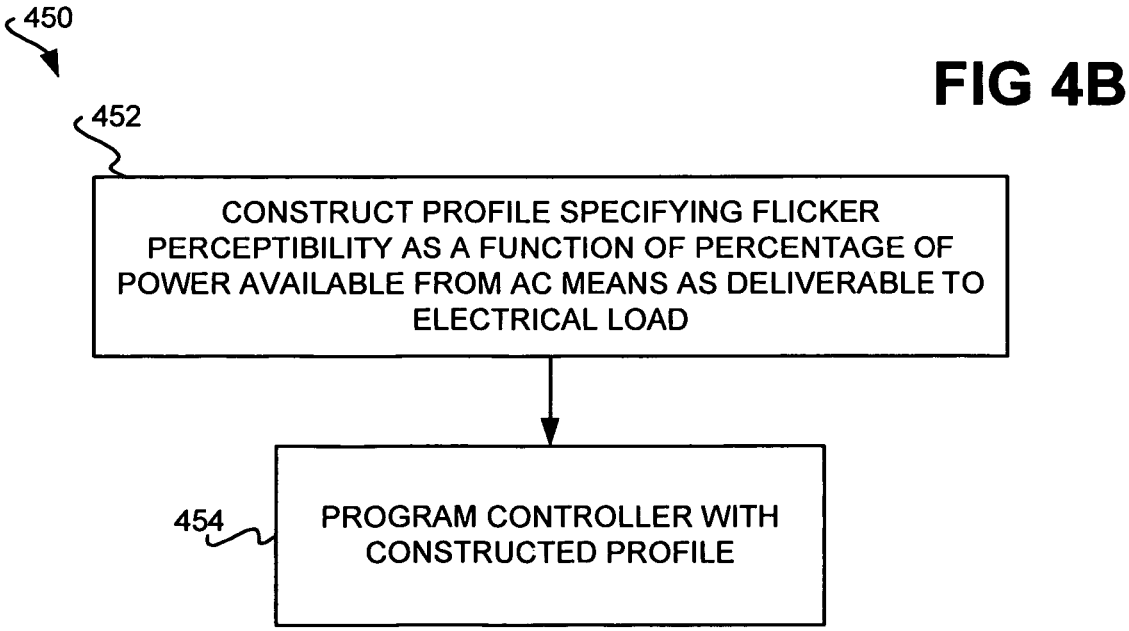
450
FIG 4B
452
CONSTRUCT PROFILE SPECIFYING FLICKER PERCEPTIBILITY AS A FUNCTION OF PERCENTAGE OF POWER AVAILABLE FROM AC MEANS AS DELIVERABLE TO ELECTRICAL LOAD
454
PROGRAM CONTROLLER WITH CONSTRUCTED PROFILE

PERCEPTIBLE FLICKERING REDUCTION

BACKGROUND

Electrical loads of electronic devices, such as the heater units of laser printers, sometimes may not use during operation all the power that can be provided by alternating-current (AC) mains, to which the electronic devices are usually connected via plugs inserted into wall outlets. Therefore, some electronic devices switch the power received from the AC mains to deliver power to the electrical loads for operation of the electrical loads. Such switching can, however, induce voltage fluctuations on the AC mains. As a result, incandescent and other types of lights that may also be currently powered by the AC mains can flicker, due to these voltage fluctuations, in a way that is perceptible to the human observer. At best, such flickering is merely annoying. However, light flickering can in extreme cases cause epileptic seizures in some people prone to these seizures, such that flickering can be considered a safety issue in these extreme situations.

BRIEF DESCRIPTION OF THE DRAWINGS

The drawings referenced herein form a part of the specification. Features shown in the drawing are meant as illustrative of some embodiments of the present disclosure, and not of all embodiments of the present disclosure, unless otherwise explicitly indicated.

FIGS. 4A and 4B are flowcharts of embodiments of methods, according to varying embodiments of the present disclosure.

DETAILED DESCRIPTION OF THE DRAWINGS

In the following detailed description of exemplary embodiments of the present disclosure, reference is made to the accompanying drawings that form a part hereof, and in which is shown by way of illustration specific exemplary embodiments present disclosure in which may be practiced. These embodiments are described in sufficient detail to enable those skilled in the art to practice the disclosed subject matter. Other embodiments may be utilized, and logical, mechanical, and other changes may be made without departing from the spirit or scope of the present disclosure. The following detailed description is, therefore, not to be taken in a limiting sense, and the scope of the present disclosure is defined by the appended claims.

Figure 1:
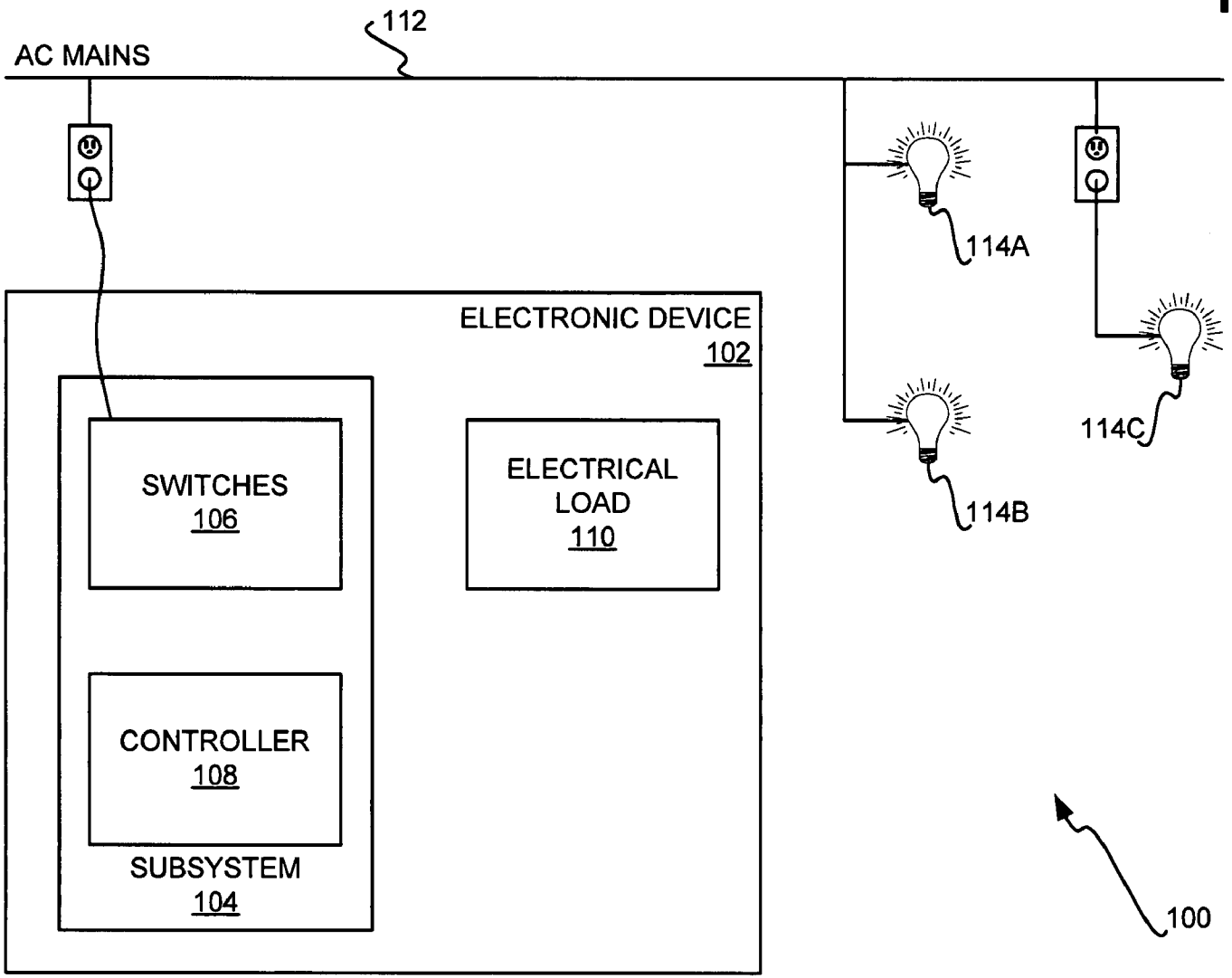
FIG. 1 is a diagram of an embodiment of a system including an embodiment of an electronic device in which there is a power-providing subsystem to deliver power from alternating-current (AC) mains to an electrical load of the device in a way that reduces perceptible flickering of lights also powered by the AC mains, according to an embodiment of the present disclosure.

FIG. 1 shows a system 100, according to an embodiment of the present disclosure. The system 100 may be or include an electronic device 102. The electronic device 102 also includes a power-providing subsystem 104, having at least one or more switches 106 and a controller 108, as well as an electrical load 110. For example, in one embodiment, the electronic device 102 may be a laser printer, where the electrical load 110 is particularly a heater that heats a fuser mechanism to fuse toner applied to sheets of media by the laser printer. In another embodiment, electronic device 102 may be an inkjet printer, where the electrical load 110 is particularly a heater used to heat air used to vaporize fluid included in ink applied to sheets of media. More generally, the electrical load 110 provides at least a portion of the intended functionality of the electronic device 102.

The electronic device 102 is connected to alternating-current (AC) mains 112. The AC mains 112 may, for instance, be the power lines that are found throughout nearly all buildings, such as offices and residences. The electronic device 102 may commonly include a cord ending in a plug that plugs into a wall outlet connected to the AC mains 112. Also shown in FIG. 1 are a number of incandescent or other types of lights 114A, 114B, and 114C, collectively referred to as the lights 114. The lights 114 are also connected to the AC mains 112, but they are not considered part of the system 100 and/or the electronic device 102, such that they are outside of the system 100 and/or the electronic device 102. The lights 114 may be connected to the same or different branch circuit of the AC mains 112 as to which the electronic device 102 is connected, as can be appreciated by those of ordinary skill within the art.

The power-providing subsystem 104 delivers power received from the AC mains 112 to the electrical load 110 of the electronic device 102, for use by the electrical load 110. In particular, the switches 106 switch the power received from the AC mains 112 so that the power that is delivered to the electrical load 110 is that percentage of the power available from the AC mains 112 to be used for proper operation of the load 110. Specific exemplary switching strategies for the switches 106 to deliver different percentages of the power received from the AC mains 112 to the electrical load 110 are described later in the detailed description. In one embodiment, the terminology "power available" refers to the power delivered to the electrical load 110, at a given impedance of the load 110, when the switches 106 are in the on state and are thus all delivering power to the load 110.

The switches 106 may be triacs, transistors, or other types of switches. The switches 106 may be zero-crossing point switches, in that they are able to turn on or turn off (i.e., switch power from the AC mains 112 on or off for delivery to the electrical load 102) at zero crossing points of the power signal provided by the AC mains 112. Such a power signal is usually a sine wave, and therefore when transitioning from positive to negative and from negative to positive, the wave crosses a zero power level. Therefore, the zero crossing points of the wave are where it crosses the zero power level, in one embodiment particularly for resistive loads. In another embodiment, the switches 106 may be phase-controlled switches, which can switch on or off at any point along the sine wave of the power signal provided by the AC mains 112.

The controller 108 of the power-providing subsystem 104 may be implemented in software, hardware, or a combination of software and hardware. The controller 108 receives signals from the electrical load 110 indicating or representing the amount of power that the load 110 is currently using for proper operation. In response, the controller 108 causes the switches 106 to provide power to the electrical load 110, such as a percentage of the available power as received from the AC mains 112. Furthermore, the controller 108 controls switching by the switches 106 so that perceptible flickering of the lights 114 is reduced, as is described in more detail later in the detailed description. The lights 114 flickering in a manner that is perceptible means that the lights 114 flicker in a way that is detectable by a human observer, without the assistance of a device that is able to detect such flickering.

For example, when the switches 106 switch on to deliver power from the AC mains 112 to deliver to the electrical load 110, the load 110 can induce a voltage sag on the AC mains 112. This voltage sag can result in the lights 114 slightly dimming, since the amount of voltage provided to the lights 114 decreases slightly. When the switches 116 then switch off to no longer deliver power from the AC mains to the electrical load 110, the load 110 no longer induces a voltage sag on the AC mains 112. As a result, the lights 114 slightly increase in brightness. When the switches 116 switch on again to deliver power from the AC mains to the electrical load 110, the load 110 again induces a voltage sag on the AC mains 112, which causes the lights 114 to again dim a little.

This dimming and brightening cycle of the lights 114 over a period of time is what can be referred to in one embodiment as the flickering of the lights 114, in a way that can be perceptible to the human observer. While the electrical load 110 is being used, the switches 106 may be repeatedly switching to provide a desired same or different level of power to the load 110, as a percentage of the available power from the AC mains 112. As a result, the lights 114 may repeatedly flicker while the electrical load 110 is being used. It is noted that human perception of flickering can depend on both the magnitude of the dimming of the lights 114, as well as the frequency at which this dimming occurs. If the dimming-brightening cycle occurs rapidly, the human observer is not able to perceive the flickering as compared to as if the dimming-brightening cycle occurs less rapidly.

The manner by which the switches 106 can be exemplarily employed to deliver different percentages of the power available from the AC mains 112 to the electrical load 110, according to an embodiment of the present disclosure, is described in relation to FIGS. 2A, 2B, 2C, 2D, and 2E. In FIGS. 2A, 2B, 2C, 2D, and 2E, it is assumed that there are just two of the switches 106, although in differing embodiments, more or less than two of the switches 106 can also be employed. In one embodiment, the switches 106 may be configured to each deliver power to a portion of the electrical load 110. Therefore, taken as a whole, the switches 106 are able to deliver varying amounts of power to the electrical load 110 taken as a whole, depending on which of the switches 106 are currently switched on, and which are currently switched off. Furthermore, it is assumed that the two switches 106 are zero-crossing point switches, although in differing embodiments, phase-control switches can also be employed. As can also be appreciated by those of ordinary skill within the art, other switching strategies, in addition to and/or in lieu of those described here, can be employed to deliver the same or different levels of power to the electrical load 110.

Figures 2A, 2B, 2C, 2D:
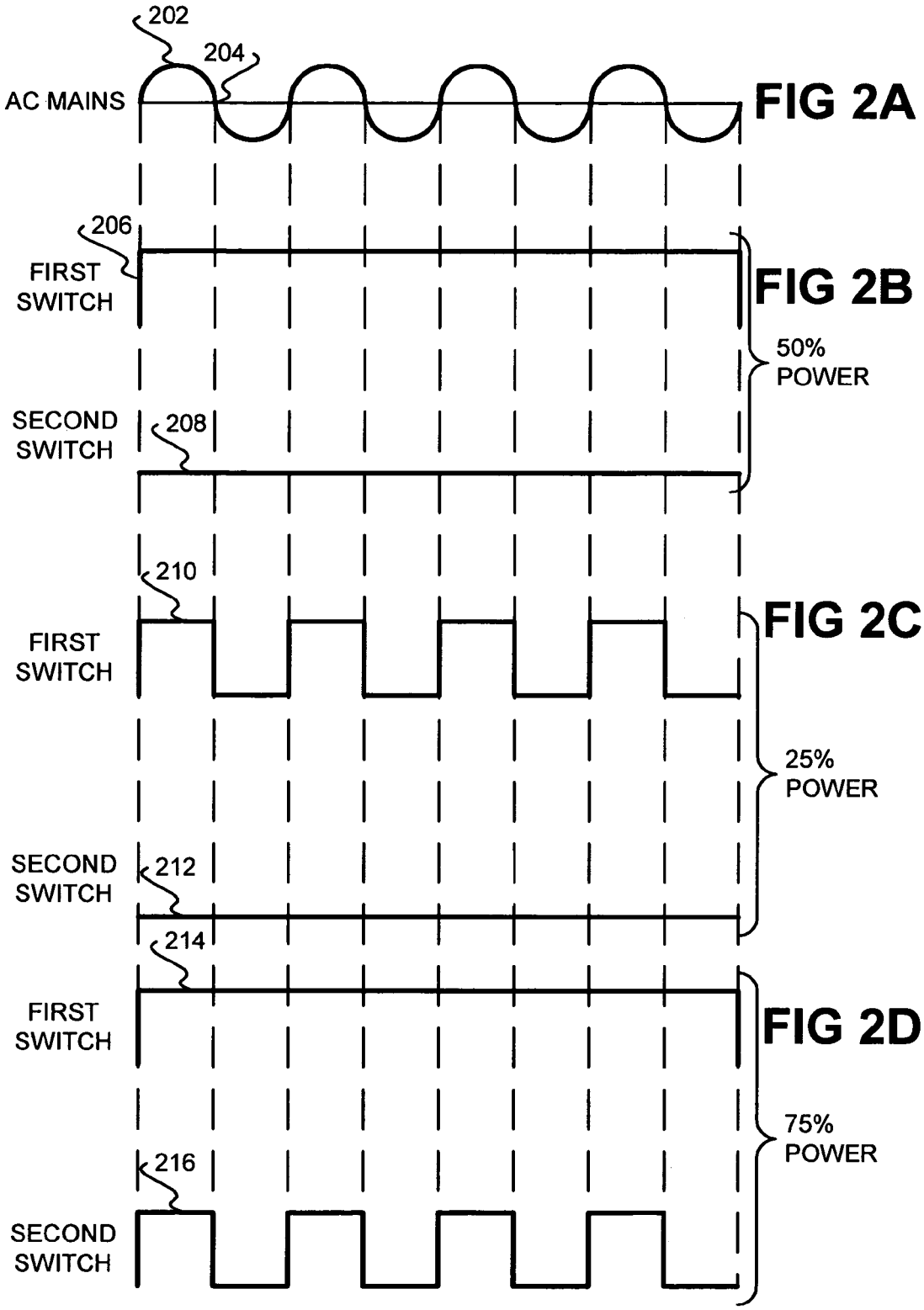
FIGS. 2A, 2B, 2C, 2D, and 2E are diagrams in relation to which how two zero-crossing point switches can be employed to deliver varying amounts of power to an electrical load is described, according to an embodiment of the present disclosure.

FIG. 2A shows a typical sine wave 202 of a power-signal provided by the AC mains 112. As the sine wave 202 goes from positive to negative, or from negative to positive, it travels past a zero crossing point. For example, as particularly indicated in FIG. 2A, one such zero crossing point 204 is specifically called out, and which the wave 202 travels past when going from positive to negative as shown in FIG. 2A. Furthermore, it is clear that if both of the switches 106 are always on when power is supplied to electrical load 110, then 100% of the power available from the AC mains 112 is delivered to the electrical load 110 during operation. Similarly, if both of the switches 106 are always off, then 0% of the power available from the AC mains 112 is delivered to the load 110, such that the load 110 does not receive power.

FIG. 2B shows an example switching strategy of the two switches 106 that can be used to deliver 50% of the power available from the AC mains 112 to the electrical load 110. In the strategy of FIG. 2B, the first switch, as indicated by the reference number 206, is switched on all the time when power is supplied to electrical load 110, whereas the second switch, as indicated by the reference number 208, is switched off all the time. Thus, 100% of the available power through the first switch is provided, and 0% of the available power through the second switch is provided, resulting in on average 50% of the power available from the AC mains 112 being delivered to the electrical load 110.

FIG. 2C shows an example switching strategy of the two switches 106 that can be used to deliver 25% of the power available from the AC mains 112 to the electrical load 110. In the strategy of FIG. 2C, the first switch, as indicated by the reference number 210, is switched on during positive half-cycles of the sine wave 202 of the power signal of FIG. 2A provided by the AC mains 112. By comparison, the second switch; as indicated by the reference number 212, is switched off all the time. Thus, 50% of the available power through the first switch is provided, and 0% of the available power through the second switch is provided, resulting in on average 25% of the power available from the AC mains 112 being delivered to the electrical load 110.

FIG. 2D shows an example switching strategy of the two switches 106 that can be used to deliver 75% of the power available from the AC mains 112 to the electrical load 110. In the strategy of FIG. 2D, the first switch, as indicated by the reference number 214, is switched on all the time when power is supplied to electrical load 110. By comparison, the second switch, as indicated by the reference number 216, is switched on during positive half-cycles of the sine wave 202 of the power signal of FIG. 2A provided by the AC mains 112. Thus, 100% of the available power through the first switch is provided, and 50% of the available power through the second switch is provided, resulting in on average 75% of the power available from the AC mains 112 being delivered to the electrical load 110 during operation.

Figure 2E:
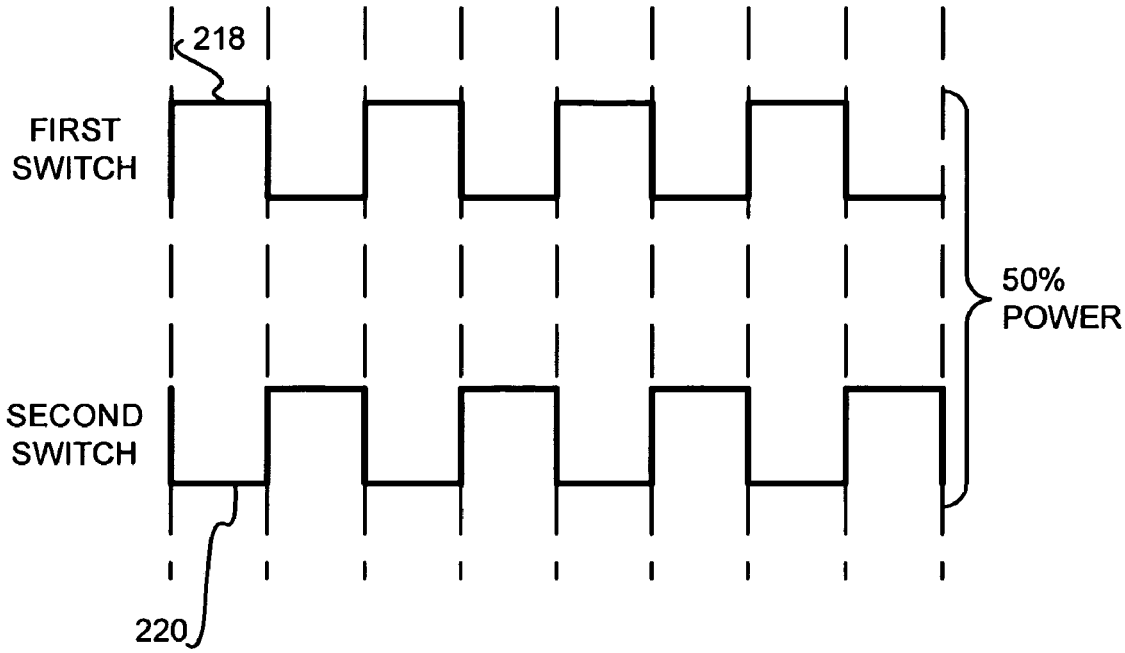

FIG. 2E shows another example switching strategy of the two switches 106 that can be used to deliver 50% of the power available from the AC mains 112 to the electrical load 110. In the strategy of FIG. 2B, the first switch, as indicated by the reference number 218, is switched on when the second switch, as indicated by the reference number 220, is switched off, and vice-versa. Thus, when 100% of the available power through the first switch is provided, 0% of the available power through the second switch is provided, and vice-versa, resulting in on average 50% of the power available from the AC mains 112 being delivered to the electrical load 110. The switches switch at substantially the same time, such that when the first switch is switching from on to off or from off to on, the second switch is switching from off to on or from on to off.

As has been noted, the controller 108 of the power-providing subsystem 104 switches the switches 106 to deliver the power available from the AC mains 112 to be used by the electrical load 110 for proper operation, such that perceptible flickering of the lights 114 is reduced. In one embodiment, the controller 108 switches the switches 106 based on a preconstructed profile that specifies flicker perceptibility as a function of a percentage of power available from the AC mains 112 as deliverable to the electrical load 110 by controlling the duty cycle of the switches 106. An example of such a profile is first described, and then strategies that can be employed to switch the switches 106 to provide power to the electrical load 110 while reducing perceptible flickering by using the profile are then described.

Figure 3:
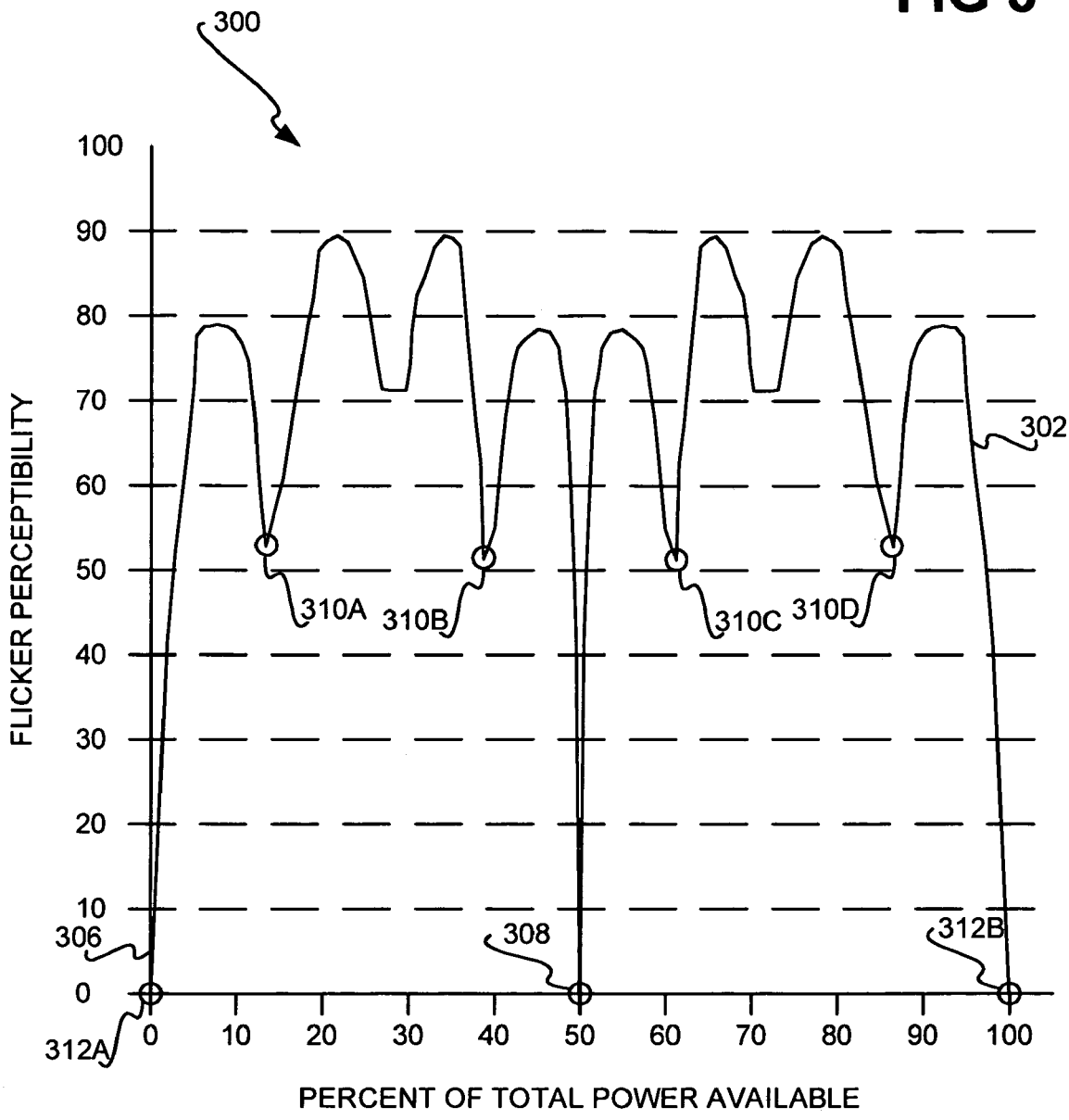
FIG. 3 is a diagram depicting flicker perceptibility as a function of percentage of power available from AC mains as deliverable to an electrical load, for two utilized switches, according to an embodiment of the present disclosure.

FIG. 3 shows an example profile as a graph 300 that specifies flicker perceptibility as a line 302, in which flicker perceptibility is measured along the y-axis 306 as a function of the percentage of power available from the AC mains 112 delivered to the electrical load 110 on the x-axis 308, according to an embodiment of the present disclosure. The profile of FIG. 3 is specifically for the case where there are two of the switches 106. The profile of FIG. 3 is also specifically for the case where the switches 106 are zero-crossing point switches.

The flicker perceptibility measured along the y-axis 306 specifies the degree of perceptibility of flickering of the lights 114, for various percentages of the power available from the AC mains 112 as delivered to the electrical load 110 on the x-axis 308, such as by the two switches 106 switching as controlled by the controller 108. Within the line 302, there are a number of nulls 312A, 312B, 308, 310A, 310B, 310C, and 310D, at which the degree of flickering perceptibility is at least at a local minimum, if not at an absolute minimum. Therefore, when power is delivered to the electrical load 110 by switching at these nulls, perceptible flickering of the lights 114 is reduced, and perhaps substantially reduced.

For instance, when no power is delivered to the electrical load 110, corresponding to the null 312A, neither of the two switches 106 is switching, and therefore there is no perceptible flickering, since no voltage sag is induced on the AC mains 112. As another example, when 100% of the power available from the AC mains 112 is delivered to the electrical load 110, corresponding to the null 312B, both of the switches 106 are always on when power is supplied to electrical load 110, and thus are not switching. There is still no perceptible flickering, since, when steady state is reached, a substantially constant voltage sag is induced on the AC mains 112, resulting in a one-time slight dimming of the lights 114.

Furthermore, when 50% of the power available from the AC mains 112 is delivered to the electrical load 110, corresponding to the null 308, there can still be no perceptible flickering. For instance, where the switching strategy described in relation to FIG. 2B may be employed, one of the switches 106 is on all the time, and one of the switches 106 is off all the time, such that the resulting amount of available power from the AC mains 112 delivered to the electrical load 110 is 50%. There is no perceptible flickering, since neither of the switches 106 is repeatedly switching on and off, and since a substantially constant voltage sag is induced on the AC mains 112. Thus, a one-time slight dimming of the lights 114 results.

As another example, where the switching strategy described in relation to FIG. 2E may be employed, one of the switches 106 is on at any give time when power is supplied to electrical load 110, and one of the switches 106 is off at any given time when power is supplied to electrical load 110, such that the resulting amount of available power from the AC mains 112 delivered to the electrical load 110 is always 50% during operation. There is no perceptible flickering, since one switch turns off at least substantially the same time the other switch turns on. Therefore, when steady state is reached, a substantially constant voltage sag is induced on the AC mains 112, such that just a one-time slight dimming of the lights 114 results.

The other nulls 310A, 310B, 310C, and 310D are collectively referred to as the nulls 310. The nulls 310 also correspond to different percentages of the power available from the AC mains 112 being delivered to the electrical load 110, such that the switches 106 switch in a manner that results in a relatively low level of flicker perceptibility. In these situations, flickering perceptibility is still greater than 50%, but is relatively low as compared to percentages of available power being delivered to the electrical load 110 that are slightly greater or less than the percentages corresponding to the nulls 310.

In general, however, for X number of zero-crossing switches employed to switch to result in a percentage of available power from the AC mains 112 to be delivered to the electrical load 110, there are X−1 nulls between, but not including, zero and 100% of the available power being delivered to the electrical load 110, and which result in less than $$(X-1)\frac{100}{X}$$

flicker perceptibility. For example, in the case of two such zero-crossing switches, as depicted in FIG. 3, there is two minus one, or one such null, the null 308, having flicker perceptibility of less than $$(2-1)\frac{100}{2},$$

or 50%. Furthermore, these nulls, other than the nulls at zero and 100%, occur at percentages as follows.

$$N_n = n\frac{100}{X}\Big|_{n=1,\ \ldots\ ,X-1} \tag{1}$$

In equation (1), for X number of zero-crossing switches, there are X−1 such nulls, and for each such null n, the null occurs at a percentage $N_n$ of available power being delivered from the AC mains 112 to the electrical load 110 as specified. For example, in the case of two such zero-crossing switches, there is a single such null 308, which occurs at the percentage of available power delivered to the load 110, $$N_1 = 1\times\frac{100}{2},$$

or 50%.

As another example, in the case of three such zero-crossing point switches 106, there are two such nulls between and not including zero and 100% of the available power from the AC mains 112 being delivered to the electrical load 110. Each of these nulls results in less than $$(3-1)\frac{100}{3},$$

or 66.7% flicker perceptibility. Furthermore, these nulls are located at the percentages of available power delivered to the electrical load 110, $$N_1 = 1\times\frac{100}{3},$$

or 33.3%, and $$N_2 = 2\times\frac{100}{3},$$

or 66.7%.

As a final example, in the case of four such zero-crossing point switches 106, there are three such nulls between and not including zero and 100% of the available power from the AC mains being delivered to the electrical load 110. Each of these nulls results in less than $$(4-1)\frac{100}{4},$$

or 75% flicker perceptibility. Furthermore, these nulls are located at the percentages of available power being delivered to the electrical load 110, $$N_1 = 1 \times \frac{100}{4},$$

or 25%, $$N_2 = 2 \times \frac{100}{4},$$

or 50%, and $$N_3 = 3 \times \frac{100}{4},$$

or 75%.

In general, then, increasing the number of zero-crossing point switches 106 employed to deliver power from the AC mains 112 to the electrical load 102 as used by the electrical load 102 increases the number of nulls as described above. However, while the number of nulls is increased, the ceiling in flicker perceptibility resulting from these nulls increases as well. That is, as has been described, for X such zero-crossing point switches 106, the nulls result in less than $$(X-1)\frac{100}{X}$$

flicker perceptibility at each such null. As a result, as X increases, this ceiling of flicker perceptibility also increases.

Three different strategies are now described for using a profile of flicker perceptibility as a function of the percentage of power available from the AC mains 112 being delivered to the electrical load 110, by switching of the switches 106. That is, three different strategies are described for the controller 108 to cause the switches 106 to switch so that a given percentage of power available from the AC mains 112 is delivered to the electrical load 110. The electrical load 110, as has been noted above, provides a signal to the controller 108 that specifies the amount of power that the electrical load 110 is to use during operation. Normally, the controller 108 would then cause the switches 106 to switch to deliver a percentage of power available from the AC mains 112 to the electrical load 110 that is equal to this requested amount, or an amount for proper operation, regardless of where the percentage of power lies within the profile.

However, in one example strategy, the controller 108 switches the switches 106 to provide a percentage of power available from the AC mains 112 to the electrical load 110 that fluctuates between the closest null to either side of the amount of power requested by the electrical load 110. For example, in relation to the example profile of FIG. 3, the electrical load 110 may request that it be provided power equal to 45% of the power available from the AC mains 112. However, this amount of power does not correspond to a null within the profile, and indeed results in relatively high flicker perceptibility.

Therefore, the controller 108 instead switches the switches 106 so they alternately provide roughly 37.5% of the power available from the AC mains 112, corresponding to the null 310B, and 50% of the power available from the AC mains 112, corresponding to the null 308. The controller 108 causes the switches 106 to switch to provide power at the percentage corresponding to each of these nulls so that on average the amount of power actually provided to the electrical load 110 is equal to the target amount of 45%. As a result, flicker perceptibility is reduced, because it varies between 0% and just over 50%, instead of being above 75% as would be the case if the amount of target power, 45%, were constantly delivered to the electrical load 110 during the time that power is supplied to electrical load 110.

In another example strategy, the controller 108 switches the switches 106 to provide a percentage of power available from the AC mains 112 to the electrical load 110 that corresponds to a null that is closest to the amount of power requested by the electrical load 110. For example, in relation to the example profile of FIG. 3, the electrical load 110 may request that it be provided power equal to 54% of the power available from the AC mains 112. However, this amount of power does not correspond to a null within the profile, and indeed results in relatively high flicker perceptibility.

Therefore, the controller 108 instead switches the switches 106 so that they provide 50% of the power available from the AC mains 112, corresponding to the null 308 that is closest to the 54% power amount requested. As a result, flicker perceptibility is reduced, and indeed substantially reduced, instead of being above 70% as would be the case if the exact amount of power, 54%, were delivered to the electrical load 110. Because the electrical load 110 receives less power than is requested, the electrical load 110 may not have sufficient power to perform its intended functionality, and therefore may request a higher amount of power relatively soon if not immediately after being provided less power than it had earlier requested.

In a final example strategy, the controller 108 switches the switches 106 to provide a percentage of power available form the AC mains 112 to the electrical load 110 that corresponds to a null that is closest to and results in a greater amount of power than that requested by the electrical load 110. For example, in relation to the example profile of FIG. 3, the electrical load 110 may request that it be provided power equal to 40% of the power available from the AC mains 112. However, this amount of power does not correspond to a null within the profile, and indeed results in a relatively high flicker perceptibility.

Therefore, the controller 108 instead switches the switches 106 so that they provide 50% of the power available from the AC mains 112, corresponding to the null 308 that is closest to and greater than the 40% power amount requested. That is, even though the null 310B is closer to the amount of power requested, it corresponds to a percentage of power that is less than the amount requested. The closest null that represents a percentage of power that is greater than the amount requested is the null 308. Flicker perceptibility is reduced, and indeed substantially reduced, instead of being above 60% as would be the case if the exact amount of power, 40%, were delivered to the electrical load 110. Because the electrical load 110 receives more power than is requested, some of the additional power may result the electrical load 110 generating additional unwanted heat, which may cause the electrical load 110 to then request a lower amount of power sooner than would otherwise be accomplished.

Three such example strategies for providing power to the electrical load 110 in response to a request for a given amount of power from the load 110, by using a profile specifying flicker perceptibility as a function of a percentage of power available from the AC mains 112 as deliverable to the load 110, to reduce perceptible flickering of the lights 114, have been described. However, as can be appreciated by those of ordinary skill within the art, these strategies are just that, examples, and do not limit all embodiments of the present disclosure. That is, other embodiments of the present disclosure may use other strategies for reducing perceptible flickering of the lights 114 by employing a profile specifying flicker perceptibility as a function of a percentage of power available from the AC mains 112 as deliverable to the electrical load 110.

FIG. 4A thus depicts an embodiment of a method 400 that can be employed to reduce flicker perceptibility on the lights 114 when the electrical load 110 is provided power from the AC mains 112 via the switches 106 switching, according to an embodiment of the present disclosure. The method 400 may therefore be performed in relation to the system 100 of FIG. 1 that has been described. More particularly, the method 400 may be performed by the controller 108 of the power-providing subsystem 104, and is exemplarily described in relation to the controller 108 performing the method 400.

The controller 108 receives a signal from the electrical load 110 that represents an amount of power for desired operation of the load 110 (402). This amount of power is referred to as a first amount of power. The power is for desired operation of the load 110 in the sense that the load 110 is requesting the first amount of power be provided to it.

Next, the controller 108 determines an amount of power to be delivered to the electrical load 110 (404), referred to as a second amount of power. The second amount of power is determined based on the first amount of power, and such that perceptible flickering of the lights 114 is reduced. For instance, the second amount of power may be determined based on the first amount of power, and based on a preconstructed profile specifying flicker perceptibility as a function of a percentage of power available from the AC mains 112 as deliverable to the electrical load 110. In different embodiments, for example, one of the three different strategies that have been described can be employed to determine the second amount of power based on this profile.

Finally, the controller 108 causes the one or more switches 106 to switch on and off such that the power from the AC mains 112 is delivered to the electrical load 110 equal, such as at least substantially equal to, the second amount of power (406). That is, the switches 106 switch so that the electrical load 110 receives the second amount of power, which may be different than the first amount of power requested by the load 110. The second amount of power is an amount which reduces flicker perceptibility within the lights 114. The method 400 may be repeated each time the electrical load 110 issues a signal representing a different amount of power thereby.

FIG. 4B shows another method 450, according to an embodiment of the present disclosure. First, a profile specifying flicker perceptibility as a function of the percentage of power available from the AC mains 112 as deliverable to the electrical load 110 is constructed (452). For instance, a specialized tool or tools, may be employed. Examples of such tools include the 6813B AC source analyzer and the 14761A flicker and harmonics test software suite, both of which are available from Agilent Technologies, Inc., of Palo Alto, Calif. Leads from the tools may be placed between the switches 106 and the electrical load 110, or it may be temporarily placed in lieu of the electrical load 110.

For each of a number of different percentages of the power available from the AC mains 112 that are delivered to the electrical load 110 and/or to this tool, the tool provides a numerical indicator denoting flicker perceptibility. When a sufficient number of flicker perceptibilities have been so acquired, interpolation may in one embodiment be used to construct the flicker perceptibility for other percentages of the power available from the AC mains 112 that are deliverable to the electrical load 110. Such interpolation techniques can include function fitting, graph fitting, and curve smoothing techniques.

Finally, the controller 108 is programmed with the constructed profile (454), so that the controller 108 may then later use the profile to reduce flicker perceptibility when controlling the switches 106 to provide power from the AC mains 112 to the electrical load 110. A table, function, graph, or other data representing the profile may be stored within the controller 108, for instance. The measured flicker perceptibilities may be programmed within the controller 108, without data corresponding to flicker perceptibilities between the measurements, such that the controller 108 performs interpolation or another technique by itself to determine flicker perceptibility for percentages of power from the AC mains 112 to be delivered to the electrical load 110 for which data has not been specifically measured. Alternatively, the flicker perceptibility for these other percentages may have already been programmed into the controller 108 as part of the profile construction process performed in part 452 of the method 450 of FIG. 4B.

It is noted, therefore, that although specific embodiments have been illustrated and described herein, it will be appreciated by those of ordinary skill in the art that any arrangement calculated to achieve the same purpose may be substituted for the specific embodiments shown. This application is intended to cover any adaptations or variations of the disclosed embodiments of the present disclosure. It is thus manifestly intended that the claimed subject matter be limited by the claims and equivalents thereof.

We claim:

1. A system comprising:

a load;

one or more switches to switch power received from a power source to power the load; and, a controller to control switching of the switches to deliver the power to the load to reduce perceptible flickering of one or more lights coupled to the power source, wherein the controller is to control switching of the switches to deliver power to the load based on a preconstructed profile specifying flicker perceptibility as a function of percentage of power available from the power source as deliverable to the load, and wherein the preconstructed profile includes a plurality of nulls at which the flicker perceptibility is at least at a local minimum, each null corresponding to a specific percentage of power available from the power source as deliverable to the load.

2. The system of claim 1, wherein for a given percentage of power available from the power source to be provided to the load, the controller provides power to the load by causing the switches to switch between two of the nulls of the preconstructed profile that are closest to the power to be provided to the load, such that on average the power is provided to the load.

3. The system of claim 1, wherein for a given percentage of power available from the power supply to be provided to the load, the controller provides power to the load by causing the switches to switch at one of the nulls of the preconstructed profile closest to the power to be provided to the load.

4. The system of claim 3, wherein for a given percentage of power available from the power supply to be provided to the load, the controller provides power to the load by causing the switches to switch at one of the nulls of the preconstructed profile closest to the power to be provided to the electrical load and that provides at least the power.

5. A power-providing subsystem for an electronic device having an electrical load, comprising:

one or more switches to switch power received from alternating-current (AC) mains to power the electrical load; and, a controller to control switching of the switches to deliver power to the electrical load, based on a preconstructed profile specifying flicker perceptibility as a function of percentage of power available from the AC mains as deliverable to the electrical load, such that perceptible flickering of one or more lights outside of the electronic device and also powered by the AC mains is reduced, wherein each of the switches is to switch the power received from the AC mains to power the electrical load at zero-crossing points of a sine wave of the power received from the AC mains.

6. The subsystem of claim 5, wherein the preconstructed profile includes a plurality of nulls at which the flicker perceptibility is at least at a relative minimum, each null corresponding to a specific percentage of power available from the AC mains as deliverable to the electrical load, and wherein for a given percentage of power available from the AC mains that is the power to be provided to the electrical load, the controller provides power to the electrical load by causing the switches to switch between two of the nulls of the preconstructed profile that are closest to the power to be provided to the electrical load, such that on average the power is provided to the electrical load.

7. The subsystem of claim 5, wherein the preconstructed profile includes a plurality of nulls at which the flicker perceptibility is at least at a relative minimum, each null corresponding to a specific percentage of power available from the AC mains as deliverable to the electrical load, and wherein for a given percentage of power available from the AC mains that is the power to be provided to the electrical load, the controller provides power to the electrical load by causing the switches to switch at one of the nulls of the preconstructed profile that is closest to the power to be provided to the electrical load.

8. The subsystem of claim 7, wherein for a given percentage of power available from the AC mains that is the power to be provided to the electrical load, the controller provides power to the electrical load by causing the switches to switch at one of the nulls of the preconstructed profile that is closest to the power to be provided to the electrical load and that provides at least the power.

9. The subsystem of claim 5, wherein the one or more switches consists essentially of two switches, the controller is to control switching of the two switches to deliver power to the electrical load based on a preconstructed profile specifying flicker perceptibility as a function of percentage of power available from the AC mains as deliverable to the electrical load, and the preconstructed profile includes one null between and not including 0 and 100 percent of power available from the AC mains that provides for substantially less than 50 percent flicker perceptibility.

10. The subsystem of claim 5, wherein the one or more switches consists essentially of three switches, the controller is to control switching of the three switches to deliver power to the electrical load based on a preconstructed profile specifying flicker perceptibility as a function of percentage of power available from the AC mains as deliverable to the electrical load, and the preconstructed profile includes two nulls between and not including 0 and 100 percent of power available from the AC mains that provides for substantially less than 66.7 percent flicker perceptibility.

11. The subsystem of claim 5, wherein the one or more switches consists essentially of four switches, the controller is to control switching of the four switches to deliver power to the electrical load based on a preconstructed profile specifying flicker perceptibility as a function of percentage of power available from the AC mains as deliverable to the electrical load, and the preconstructed profile includes three nulls between and not including 0 and 100 percent of power available from the AC mains that provides for substantially less than 75 percent flicker perceptibility.

12. A method comprising:

receiving a signal representing a first amount of power to be provided to an electrical load, from the electrical load;

determining a second amount of power to deliver to the electrical load, based on the first amount of power to be provided to the electrical load, to reduce perceptible flickering of one or more lights powered by a power source is reduced; and, causing one or more switches to switch power received from the power source to deliver the second amount of power to the electrical load, wherein determining the second amount of power to deliver to the electrical load comprises determining the second amount of power based on a preconstructed profile specifying flicker perceptibility as a function of percentage of power available from AC mains as deliverable to the electrical load, the preconstructed profile including a plurality of nulls at which the flicker perceptibility is at least at a local minimum, each null corresponding to a specific percentage of power available from the AC mains as deliverable to the electrical load.

13. The method of claim 12, wherein determining the second amount of power based on the preconstructed profile comprises determining two nulls corresponding to two specific percentages of power available from the AC mains between which the first amount of power is ordered, such that the second amount of power to be delivered to the electrical load is an average of the two specific percentages of power available and is at least substantially equal to the first amount of power, and wherein causing the switches to switch the power received from the AC mains to deliver the second amount of power to the electrical load comprises causing the switches to switch between the two nulls.

14. The method of claim 12, wherein determining the second amount of power based on the preconstructed profile comprises determining a selected null corresponding to a specific percentage of power available from the AC mains that is closest to the first amount of power, such that the first amount of power to be delivered to the electrical load is close but not equal to the first amount of power, and wherein causing the switches to switch the power received from the AC mains to deliver the second amount of power to the electrical load comprises causing the switches to switch at the selected null.

15. The method of claim 12, wherein determining the second amount of power based on the preconstructed profile comprises determining a selected null corresponding to a specific percentage of power available from the AC mains that is closest to but greater than the first amount of power, such that the first amount of power to be delivered to the electrical load is close but not equal to the first amount of power, and wherein causing the switches to switch the power received from the AC mains to deliver the second amount of power to the electrical load comprises causing the switches to switch at the selected null.

* * * * *